US009299318B2

(12) United States Patent
Oh et al.

(10) Patent No.: US 9,299,318 B2
(45) Date of Patent: Mar. 29, 2016

(54) DISPLAY DEVICE AND IMAGE SIGNAL COMPENSATING METHOD

(71) Applicant: SAMSUNG DISPLAY CO., LTD., Yongin, Gyeonggi-Do (KR)

(72) Inventors: Kwan-Young Oh, Yongin (KR); Youn Jin Jung, Yongin (KR); Po-Yun Park, Yongin (KR); Jae-Won Jeong, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 121 days.

(21) Appl. No.: 14/163,073

(22) Filed: Jan. 24, 2014

(65) Prior Publication Data

US 2014/0320521 A1 Oct. 30, 2014

(30) Foreign Application Priority Data

Apr. 25, 2013 (KR) ..... 10-2013-0046296

(51) Int. Cl.

| | |
|---|---|
| ***G09G 5/00*** | (2006.01) |
| ***G09G 5/02*** | (2006.01) |
| ***G09G 3/20*** | (2006.01) |
| ***G09G 3/36*** | (2006.01) |
| ***G09G 5/18*** | (2006.01) |
| ***G09G 3/32*** | (2006.01) |

(52) U.S. Cl.

CPC ..... *G09G 5/02* (2013.01); *G09G 3/3225* (2013.01); *G09G 3/3648* (2013.01); *G09G 2300/0426* (2013.01); *G09G 2310/0205* (2013.01); *G09G 2310/0251* (2013.01); *G09G 2320/0285* (2013.01)

(58) Field of Classification Search

USPC ..... 345/589, 600–601, 606, 204–205, 212, 345/214, 690, 87

See application file for complete search history.

(56) References Cited

U.S. PATENT DOCUMENTS

| | | | | |
|---|---|---|---|---|
| 7,061,464 | B2 | 6/2006 | Park et al. | |
| 7,532,186 | B2 | 5/2009 | Tsai et al. | |
| 7,742,030 | B2 | 6/2010 | Tsai et al. | |
| 7,932,884 | B2 | 4/2011 | Song et al. | |
| 8,068,123 | B2 | 11/2011 | Ahn | |
| 2005/0093803 | A1 * | 5/2005 | Cheon et al. | 345/92 |

(Continued)

FOREIGN PATENT DOCUMENTS

| | | | |
|---|---|---|---|
| KR | 10-2006-0020054 | A | 3/2006 |
| KR | 10-2006-0134779 | A | 12/2006 |

(Continued)

*Primary Examiner* — Wesner Sajous

(74) *Attorney, Agent, or Firm* — Lee & Morse, P.C.

(57) ABSTRACT

A display device includes a first pixel connected to a first gate line and a data line, a second pixel connected to a second gate line, different from the first gate line, and the data line, the second pixel being pre-charged when the first pixel is charged, a compensation LUT which stores LUT values for compensating a charging rate during a main charging of the second pixel; and an image signal processor which generates a compensated image signal for the main charging of the second pixel. The image signal processor may include a correction value calculating unit which calculates a correction value from the compensation LUT based on first and second input image signal of respective first and second pixels, and a compensated value generating unit which generates a compensated image signal for the second pixel based on the correction value and the second input image signal.

20 Claims, 15 Drawing Sheets

(56) References Cited

U.S. PATENT DOCUMENTS

| | | | | |
|---|---|---|---|---|
| 2007/0120794 | A1* | 5/2007 | Shin et al. | 345/89 |
| 2007/0279323 | A1* | 12/2007 | Park et al. | 345/55 |
| 2008/0191987 | A1 | 8/2008 | Lee et al. | |
| 2008/0231589 | A1* | 9/2008 | So et al. | 345/102 |
| 2008/0309683 | A1* | 12/2008 | Kim et al. | 345/690 |
| 2010/0231617 | A1 | 9/2010 | Ueda et al. | |
| 2011/0234569 | A1 | 9/2011 | Ooishi et al. | |
| 2011/0298774 | A1* | 12/2011 | Yamada et al. | 345/211 |
| 2013/0169619 | A1 | 7/2013 | Jeong et al. | |
| 2014/0022289 | A1* | 1/2014 | Lee et al. | 345/691 |

FOREIGN PATENT DOCUMENTS

| | | | |
|---|---|---|---|
| KR | 10-2009-0055147 | A | 6/2009 |
| KR | 10-2013-0079950 | A | 7/2013 |

* cited by examiner

FIG. 6

PXb →

PXa ↓

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 1 | 2 | 3 | 5 | 7 | 7 | 7 | 6 | 6 | 4 | 3 | 2 | 1 | 0 | 0 | 0 |
| 16 | 0 | 0 | 1 | 2 | 3 | 3 | 4 | 4 | 4 | 3 | 2 | 1 | 0 | 0 | 0 | 0 | 0 |
| 32 | 0 | 0 | 0 | 0 | 0 | 0 | 0 | 0 | 0 | 0 | 0 | 0 | 0 | 0 | 0 | 0 | 0 |
| 48 | 0 | 1 | 0 | 0 | 0 | 0 | 0 | 0 | 0 | 0 | 0 | 0 | 0 | 0 | 0 | 0 | 0 |
| 64 | 0 | 1 | 1 | 0 | 0 | 0 | 0 | 0 | 0 | 0 | 0 | 0 | 0 | 0 | 0 | 0 | 0 |
| 80 | 0 | 1 | 1 | 0 | 0 | 0 | 0 | 0 | 0 | 0 | 0 | 0 | 0 | 0 | 0 | 0 | 0 |
| 96 | 0 | 1 | 1 | 0 | 0 | 0 | 0 | 0 | 0 | 0 | 0 | 0 | 0 | 0 | 0 | 0 | 0 |
| 112 | 0 | 1 | 1 | 2 | 0 | 0 | 0 | 0 | 0 | 0 | 0 | 0 | 0 | 0 | 0 | 0 | 0 |
| 128 | 0 | 1 | 1 | 2 | 0 | 0 | 0 | 0 | 0 | 0 | 0 | 0 | 0 | 0 | 0 | 0 | 0 |
| 144 | 0 | 1 | 1 | 2 | 3 | 0 | 0 | 0 | 0 | 0 | 0 | 0 | 0 | 0 | 0 | 0 | 0 |
| 160 | 0 | 1 | 1 | 2 | 3 | 3 | 0 | 0 | 0 | 0 | 0 | 0 | 0 | 0 | 0 | 0 | 0 |
| 176 | 0 | 1 | 1 | 2 | 3 | 3 | 3 | 0 | 0 | 0 | 0 | 0 | 0 | 0 | 0 | 0 | 0 |
| 192 | 0 | 1 | 1 | 2 | 3 | 3 | 3 | 3 | 0 | 0 | 0 | 0 | 0 | 0 | 0 | 0 | 0 |
| 208 | 0 | 1 | 1 | 2 | 3 | 3 | 3 | 3 | 0 | 0 | 0 | 0 | 0 | 0 | 0 | 0 | 0 |
| 224 | 0 | 1 | 1 | 2 | 3 | 3 | 3 | 3 | 3 | 0 | 0 | 0 | 0 | 0 | 0 | 0 | 0 |
| 240 | 0 | 1 | 1 | 2 | 3 | 3 | 3 | 3 | 3 | 2 | 0 | 0 | 0 | 0 | 0 | 0 | 0 |
| 255 | 0 | 1 | 1 | 2 | 3 | 3 | 3 | 3 | 3 | 2 | 1 | 0 | 0 | 0 | 0 | 0 | 0 |

FIG. 7

Compensation LUT

VL1 VL2

| | 0 | 16 | 32 | 48 | 64 | 80 |
|---|---|---|---|---|---|---|
| 0 | 0 | 2 | 4 | 8 | 12 | 14 |
| 16 | 0 | 0 | 0 | 2 | 6 | 6 |
| 32 | 0 | 0 | 0 | 0 | 0 | 0 |
| 48 | 0 | 0 | 0 | 0 | 0 | 0 |
| 64 | 0 | 2 | 0 | 0 | 0 | 0 |

VL4 VL3

DISPLAY DEVICE AND IMAGE SIGNAL COMPENSATING METHOD

CROSS-REFERENCE TO RELATED APPLICATION

Korean Patent Application No. 10-2013-0046296, filed on Apr. 25, 2013, in the Korean Intellectual Property Office, and entitled: "Display Device and Image Signal Compensating Method," is incorporated by reference herein in its entirety.

BACKGROUND

1. Field

Embodiments relate to a display device and an image signal compensating method, and more particularly, to a display device and an image signal compensating method which improve a display quality.

2. Description of the Related Art

A display device, such as a liquid crystal display (LCD) or an organic light emitting diode display, generally includes a display panel having a plurality of pixels and a plurality of signal lines, and a driving unit which drives the display panel. Each pixel includes a switching element connected to the signal line, a pixel electrode connected thereto, and an opposed electrode. The driving unit includes a gate driver which supplies a gate signal to the display panel, a data driver which supplies a data signal to the display panel, and a signal controller which controls the data driver and the gate driver.

The pixel electrode is connected to the switching element such as a thin film transistor (TFT) and a data voltage is applied to the pixel electrode. The opposed electrode is formed on an entire surface of the display panel and a common voltage Vcom is applied thereto. The pixel electrode and the opposed electrode may be disposed on the same substrate or on different substrates.

For example, the liquid crystal display includes two display panels which have the pixel electrode and the opposed electrode and a liquid crystal layer having a dielectric anisotropy interposed therebetween. The pixel electrodes are formed in a matrix and are connected to the switching elements, e.g., thin film transistors (TFTs), so that the data voltage is sequentially applied to every row of the pixel electrodes. The opposed electrode is formed on the entire surface of the display panel and a common voltage Vcom is applied thereto. A voltage is applied to the pixel electrode and the opposed electrode to generate an electric field in the liquid crystal layer and an intensity of the electric field is adjusted to adjust a transmittance of light which passes through the liquid crystal layer to obtain a desired image.

The display device receives an input image signal from an external graphic controller and the input image signal contains luminance information of each pixel and the luminance has a predetermined number. The pixel is applied with a data voltage corresponding to desired luminance information. The data voltage which is applied to the pixel is represented as a pixel voltage in accordance with a difference from a common voltage which is applied to the common electrode and each pixel displays the luminance represented by a gray scale of the image signal in accordance with the pixel voltage. In this case, in the liquid crystal display, in order to prevent deterioration occurring when an electric field in one direction is applied to the liquid crystal layer for a long time, a polarity of a data voltage with respect to a reference voltage for every frame, every row, every column, or every pixel may be reversed.

Recently, a higher quality image can be provided as the resolution of the display device becomes higher, so that the resolution of the display device is increased. Therefore, as the resolution becomes higher, a time to charge the pixel with the data voltage may be shortened. Particularly, if the polarity of the data voltage is reversed, a time to charge the data voltage to be a target data voltage may be insufficient.

In order to supplement the charging time, generally, a pre-charging method is used. The pre-charging method previously transmits a pre-charging voltage before applying a target data voltage to each pixel so that a pixel voltage for representing a target luminance may be rapidly reached at the time of main-charging the pixel.

The above information disclosed in this Background section is only for enhancement of understanding of the background of the invention and therefore it may contain information that does not form the prior art that is already known in this country to a person of ordinary skill in the art.

SUMMARY

An exemplary embodiment of the present invention provides a display device including a first pixel which is connected to a first gate line and a data line; a second pixel which is connected to a second gate line which is different from the first gate line and the data line, the second pixel being pre-charged during a pre-charging period when the first pixel is charged and mainly charged during a main charging period after finishing charging of the first pixel; a compensation LUT which stores LUT values for compensating a charging rate during the main charging period of the second pixel; and an image signal processor which generates a compensated image signal for the main charging period of the second pixel. The image signal processor may include a correction value calculating unit which calculates a correction value from the compensation LUT based on a first input image signal of the first pixel and a second input image signal of the second pixel; and a compensated value generating unit which generates a compensated image signal of the second pixel by adding or subtracting the correction value to or from the second input image signal of the second pixel.

The compensated value generating unit may subtract the correction value from the second input image signal if a gray value of the first input image signal is larger than a gray value of the second input image signal, and adds the correction value to the second input image signal if a gray value of the first input image signal is smaller than a gray value of the second input image signal.

The display device may further include a display panel including a plurality of pixels arranged in a matrix, the plurality of pixels including the first pixel and the second pixel, and the image signal processor may include a target pixel extracting unit which sets a basic unit which is a repeated structure of the display panel and a reference region which is equal to or larger than the basic unit, extracts a target pixel for compensating of an image signal from the basic unit, the target pixel including the second pixel, and extracts at least two reference pixels including the first pixel and the second pixel from the reference region.

The display device may further include a primary color compensation avoiding unit which, if a dot including the second pixel expresses a primary color, allows the image signal processor to output the second input image signal which is not compensated.

The image signal processor may further include a specific dither map avoiding unit which, if a dithering map for the compensated image signal corresponds to a specific dithering map, adjusts the compensated image signal so as to avoid the specific dithering map.

The image signal processor may include the primary color compensation avoiding unit, and an operating order of the primary color compensation avoiding unit and the specific dither map avoiding unit may be changable.

The compensation LUT may store a plurality of LUT values corresponding to a plurality of gray values of the first input image signal of the first pixel and a plurality of gray values of the second input image signal of the second pixel, and the LUT value on a diagonal of the compensation LUT may be zero.

The correction value calculating unit may use interpolation to calculate the correction value.

Another exemplary embodiment of the present invention provides an image signal compensating method of a display device including: during a pre-charging period when a first pixel which is connected to a first gate line and a data line is charged, pre-charging a second pixel which is connected to a second gate line different from the first gate line and the data line; calculating a correction value from a compensation LUT based on a first input image signal of the first pixel and a second input image signal of the second pixel; generating a compensated image signal of the second pixel by adding or subtracting the correction value to or from the second input image signal of the second pixel; and main-charging the second pixel with a data voltage corresponding to the compensated image signal during a main-charging period after finishing charging of the first pixel.

In the generating of the compensated image signal of the second pixel, if a gray value of the first input image signal is larger than a gray value of the second input image signal, the correction value is subtracted from the second input image signal, and, if a gray value of the first input image signal is smaller than a gray value of the second input image signal, the correction value may be added to the second input image signal.

The method may further include setting a basic unit which is a repeated structure of the display panel and a reference region which is equal to or larger than the basic unit; extracting a target pixel for compensating of an image signal from the basic unit, the target pixel including the second pixel; and extracting at least two reference pixels including the first pixel and the second pixel from the reference region.

The method may further include, if a dot including the second pixel expresses a primary color, outputting the second input image signal which is not compensated.

The method may further include if a dithering map for the compensated image signal corresponds to a specific dithering map, adjusting the compensated image signal so as to avoid the specific dithering map.

The compensation LUT may store a plurality of LUT values corresponding to a plurality of gray values of the first input image signal of the first pixel and a plurality of gray values of the second input image signal of the second pixel, and the LUT value on a diagonal of the compensation LUT may be zero.

The calculating of the correction value may include using an interpolation.

BRIEF DESCRIPTION OF THE DRAWINGS

Features will become apparent to those of skill in the art by describing in detail exemplary embodiments with reference to the attached drawings in which:

FIG. 6 illustrates a view of an example of a look-up table for compensating an image signal in the display device according to the exemplary embodiment of the present invention.

FIG. 7 illustrates a drawing of a method of selecting an LUT value which is referred to in a look-up table for compensating the image signal of the display device according to the exemplary embodiment.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
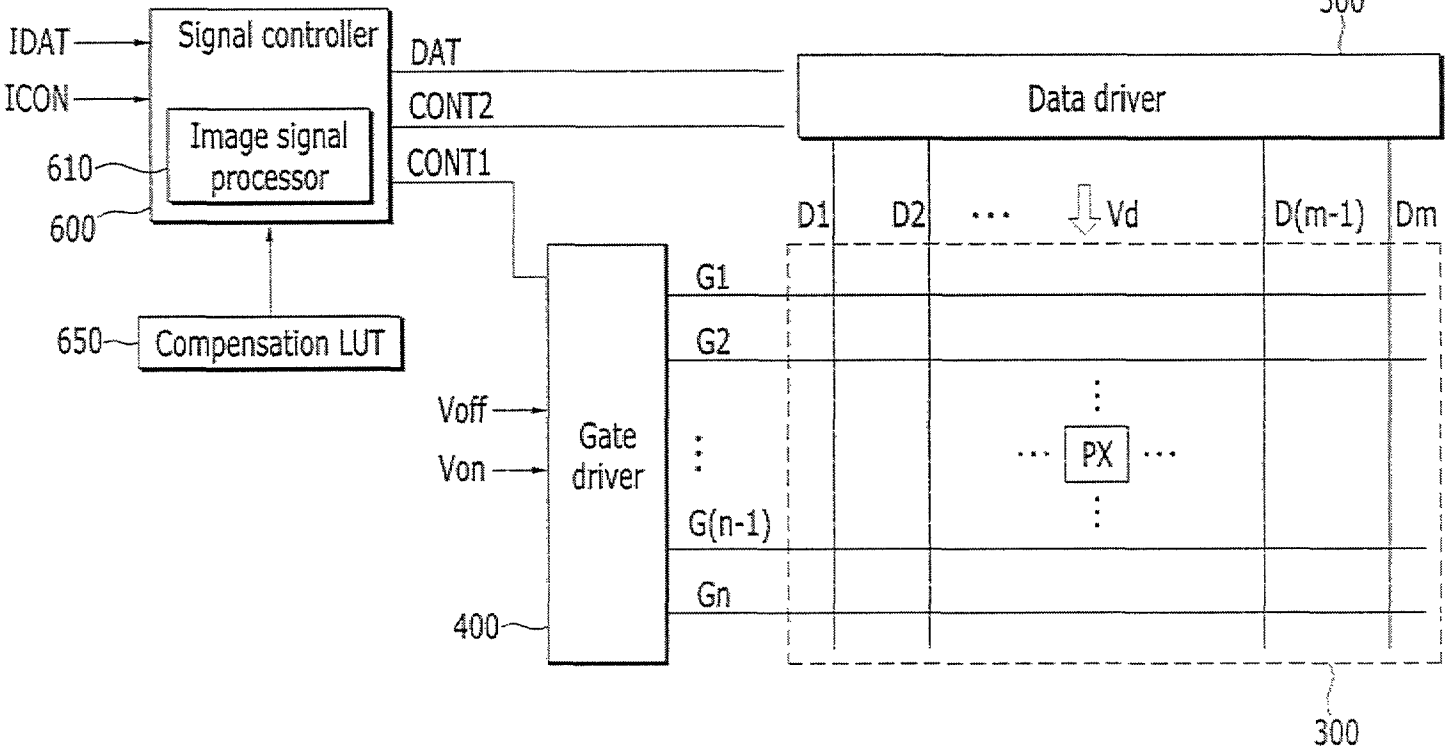
FIG. 1 illustrates a block diagram of a display device according to an exemplary embodiment.

First, referring to FIG. 1, a display device according to an exemplary embodiment will be described. FIG. 1 illustrates a block diagram of a display device according to an exemplary embodiment.

Referring to FIG. 1, the display device according to the exemplary embodiment includes a display panel 300, a gate driver 400 and a data driver 500 connected to the display panel 300, a signal controller 600, and a compensation look-up table (LUT) 650 connected to the signal controller 600.

The display panel 300 includes a plurality of signal lines and a plurality of pixels PX connected to the plurality of signal lines and arranged approximately in a matrix as seen from an equivalent circuit. If the display device is a liquid crystal display, the display panel 300, as seen from a cross-sectional view, may include lower and upper panels (not shown) which face each other and a liquid crystal layer (not shown) interposed therebetween.

The signal line includes a plurality of gate lines G1 to Gn which transmits a gate signal (also referred to as a "scanning signal") and a plurality of data lines D1 to Dm which transmits a data voltage.

The pixel PX may include at least one switching element (not shown) connected to at least one data line D1, D2, . . . , Dm and at least one gate line G1, G2, . . . , Gn and at least one pixel electrode (not shown) connected thereto. The switching element may include at least one thin film transistor and is controlled in accordance with a gate signal transmitted from the gate lines G1, G2, . . . , Gn to transmit a data voltage Vd transmitted from the data lines D1, D2, . . . , Dm to the pixel electrode of each pixel PX.

In order to implement color display, each pixel PX displays one of primary colors (spatial division) or each pixel alternately displays the primary colors as time goes by (temporal division) to recognize a desired color by spatial and temporal sum of the primary colors. Examples of primary colors include three primary colors such as red, green, and blue. A plurality of adjacent pixels PX which displays different primary colors may form one set (referred to as a dot) and one dot may display a white image. In the exemplary embodiment, an example which has three primary colors of red, green, and blue as base colors will be mainly described.

The data driver 500 is connected to the data lines D1 to Dm, selects a gray voltage based on an output image signal DAT input from the signal controller 600 and applies the gray voltage to the data lines D1 to DM as a data voltage Vd. The data driver 500 may receive a gray voltage generated in a separate gray voltage generator (not shown) or receive only limited number of reference gray voltages to divide the voltage to generate a gray voltage for the entire gray levels.

The gate driver 400 is connected to the gate lines G1 to Gn to apply a gate signal formed of a combination of a gate-on voltage Von and a gate-off voltage Voff to the gate lines G1 to Gn.

The signal controller 600 receives an input image signal IDAT and an input control signal ICON from a graphic controller (not shown) and controls an operation of the gate driver 400 and the data driver 500.

The graphic controller processes the image data input from the outside to generate the input image signal IDAT and then transmits the input image signal IDAT to the signal controller 600. For example, the graphic controller may or may not perform frame rate control which inserts an intermediate frame between adjacent frames in order to reduce motion blur.

The input image signal IDAT stores luminance information of each pixel PX and the luminance has predetermined number of gray levels. The input image signal IDAT may be provided for every primary color which is represented by the pixel PX. For example, if the pixel PX represents any one of the primary colors of red, green, and blue, the input image signal IDAT may include a red image signal, a green image signal, and a blue image signal.

Examples of the input control signal ICON include a vertical synchronization signal, a horizontal synchronizing signal, a main clock signal, and a data enable signal.

The signal controller 600 processes the input image signal IDAT based on the input image signal IDAT and the input control signal ICON to convert the input image signal into an output image signal DAT and generate a gate control signal CONT1 and a data control signal CONT2. The data control signal CONT2 may further include an inversion signal which inverts a polarity of the data voltage Vd for the common voltage Vcom (referred to as a polarity of data voltage).

The signal controller 600 includes an image signal processor 610 which processes the input image signal IDAT in accordance with a condition of the display panel 300.

The compensation LUT 650 includes compensation data (referred to as a compensation LUT value) required to process the image signal in the image signal processor 610 of the signal controller 600. The compensation LUT 650 may be stored in an EEPROM. The compensation LUT 650 may be included in the signal controller 600 of FIG. 1 or may be external thereto, as shown in FIG. 1.

Now, a display driving method of the display device will be described.

The signal controller 600 receives the input image signal IDAT and an input control signal ICON which controls the display thereof from the outside. The signal controller 600 processes the input image signal IDAT to convert the input image signal into the output image signal DAT and generate a gate control signal CONT1 and a data control signal CONT2. The signal controller 600 sends the gate control signal CONT1 to the gate driver 400 and sends the data control signal CONT2 and the output image signal DAT to the data driver 500.

The data driver 500 receives the output image signal DAT for one row of pixels PX in accordance with the data control signal CONT2 from the signal controller 600 and selects a gray voltage corresponding to the output image signal DAT to convert the output image signal DAT into an analog data voltage Vd and then applies the analog data voltage to the data lines D1 to Dm.

The gate driver 400 applies a gate-on voltage Von to the gate lines G1 to Gn in accordance with the gate control signal CONT1 from the signal controller 600 to turn on a switching element which is connected to the gate lines G1-Gn. By doing this, the data voltage Vd which is applied to the data lines D1 to Dm is applied to the pixel PX through the turned-on switching element to be represented as a pixel voltage which is a charging voltage of the pixel PX. If the data voltage Vd is applied to the pixel PX, the pixel PX may display a luminance corresponding to the data voltage Vd through various optical converting elements. For example, in the case of a liquid crystal display, a degree of inclination of liquid crystal molecules of a liquid crystal layer is controlled to adjust polarization of light to display the luminance corresponding to the gray level of the input image signal IDAT.

The processes are repeated with a horizontal period [written as "1H" and equal to one period of a horizontal synchronizing signal Hsync and a data enable signal DE] as one unit to sequentially apply the gate on voltage Von to all gate lines G1 to Gn and apply the data voltage Vd to all pixels PX to display an image of one frame.

A next frame start at the end of one frame and a status of an inversion signal included in the data control signal CONT2 is controlled such that a polarity of the data voltage Vd applied to each pixel PX is opposite to a polarity of the previous frame (referred to as frame inversion). At the time of frame inversion, a polarity of the data voltage Vd which is applied to the entire pixels PX for every at least one frame may be inverted. Also in one frame, the polarity of the data voltage Vd which flows through one of the data lines D1 to Dm is periodically changed in accordance with a characteristic of the inversion signal or polarities of the data voltages Vd which are applied to the data lines D1 to Dm of one pixel row may be different from each other.

Figure 2:
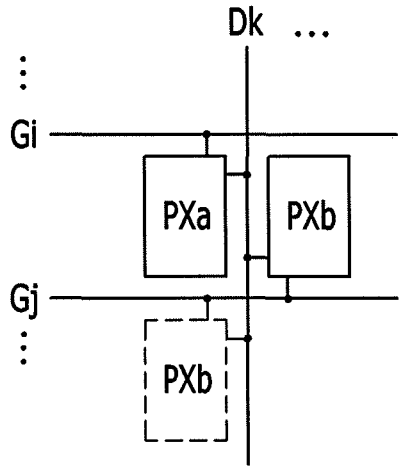
FIG. 2 illustrates a layout view of a pixel and a signal line of the display device according to the exemplary embodiment.
Figure 3:
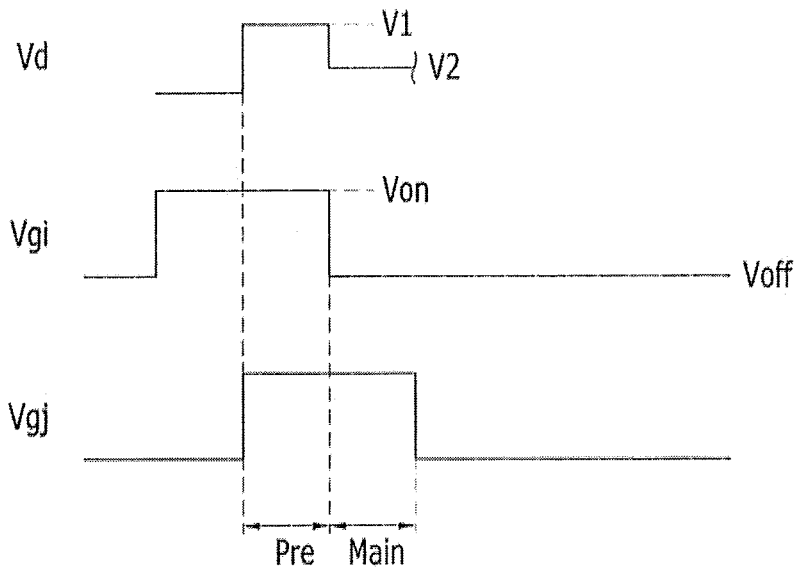
FIG. 3 illustrates a timing chart of a driving signal of the display device according to the exemplary embodiment.

Referring to FIGS. 2 and 3, together with FIG. 1 which has been described above, an example of a specific structure and a pre-charging method of the display device according to the exemplary embodiment will be described.

FIG. 2 illustrates a layout view of the pixel and the signal line of the display device according to the exemplary embodiment. FIG. 3 illustrates a timing chart of the driving signal of the display device according to the exemplary embodiment.

Referring to FIGS. 2 and 3, the display device according to the exemplary embodiment of the present invention includes at least two pixels PXa and PXb which are connected to different gate lines G1 and Gj (i, j=1, 2, . . . , n) and same data lines Dk (k=1, 2, . . . , m). FIG. 2 shows a first pixel PXa connected to a first gate line G1 and a data line Dk and a second pixel PXb connected to a second gate line Gj and the data line Dk as examples. The at least two pixels PXa and PXb may be disposed on one pixel row as shown by a solid line of FIG. 2 or disposed on different pixel rows as shown by a dotted line of FIG. 2.

Referring to FIG. 3, the first gate line Gi and the second gate line Gj transmit gate signals Vgi and Vgj, and gate-on voltage Von periods of the gate signals Vgi and Vgj partially overlap each other. When the first gate line Gi transmits the gate-on voltage Von prior to the second gate line Gj, a portion of the gate-on voltage Von period of the second gate line Gj which overlaps the gate on voltage Von period of the first gate line Gi is referred to as a pre-charge period Pre and a portion which does not overlap the gate-on voltage Von period of the first gate line Gi is referred to as a main-charge period Main.

The pre-charge period Pre of the second gate line Gj may correspond to the main-charge period Main of the first gate line Gi. That is, during the pre-charge period Pre of the second gate line Gj, the first pixel PXa connected to the first gate line Gi is charged by a first data voltage V1 which corresponds to the output image signal DAT of the first pixel PXa of the data voltage Vd transmitted by the data line Dk through a turned-on switching element. In this case, the gate on voltage Von is also transferred to the switching element connected to the second pixel PXb connected to the second gate line Gj so that the second pixel PXb is also pre-charged by the first data voltage V1 which is the same data voltage Vd.

During the main-charge period Main of the second gate line Gj, the data voltage Vd is not transmitted to the first pixel PXa, but the second pixel PXb is main-charged by the second data voltage V2 corresponding to the output image signal DAT of the second pixel PXb among the data voltage Vd through the turned-on switching element. When the display device according to the exemplary embodiment is driven by frame inversion, if the first data voltage Vd and the second data voltage V2 are the same polarity as the common voltage, the second pixel PXb is pre-charged in advance by the first data voltage V1 which has the same polarity as the second data voltage V2 during the pre-charge period Pre. Therefore, during the main-charge period Main, the pixel voltage of the second pixel PXb may rapidly reach a target luminance.

In such a pre-charging method, for convenience sake, the second pixel PXb to be pre-charged is referred to as a "pixel to be pre-charged" and the first pixel PXa which has the pre-charged first data voltage V1 of the second pixel PXb as a main-charge voltage is referred to as a "pixel which affects the pre-charging".

The gray level of the main-charge voltage of the pixel which affects the pre-charging may vary from a lowest gray level to a highest gray level in accordance with the input image signal IDAT. Accordingly, the voltage to which the pixel to be pre-charged is pre-charged during the pre-charge period Pre may vary depending on the gray level of the image signal of the pixel which affects the pre-charging so that the charging rate of the pixel to be pre-charged may have deviation depending on the position of the pixel so that the luminance may vary. Particularly, when a specific color is represented, if the influence by the pre-charge varies depending on the position of the pixels to be pre-charged which represent the same primary color, the luminance varies, which may be recognized as a mura.

The image signal processor 610 of the signal controller 600 of the display device according to the exemplary embodiment of the present invention performs a signal processing operation which compensates the deviation of the charging rate to remove the luminance deviation of a pre-charged pixel, i.e., image signal compensation.

A specific structure of the image signal processor 610 will be described with reference to FIGS. 4 to 8 together with the above-described drawings.

Figure 4:
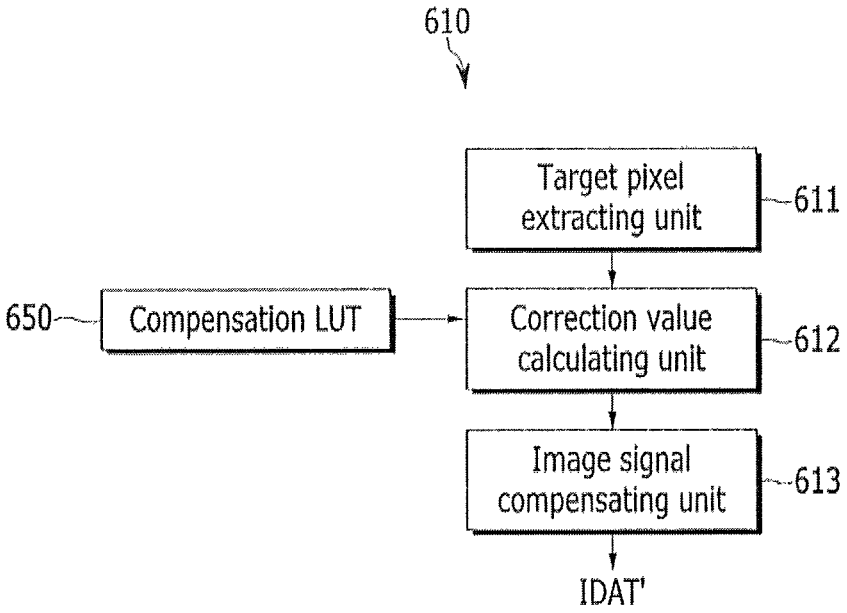
FIG. 4 illustrates a block diagram of an image signal processor of the display device according to the exemplary embodiment.
Figure 5:
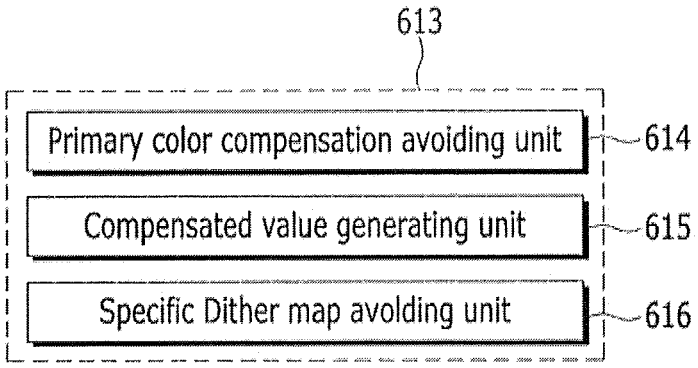
FIG. 5 illustrates a block diagram of an image signal compensating unit included in the image signal processor of the display device according to the exemplary embodiment.
Figure 8:
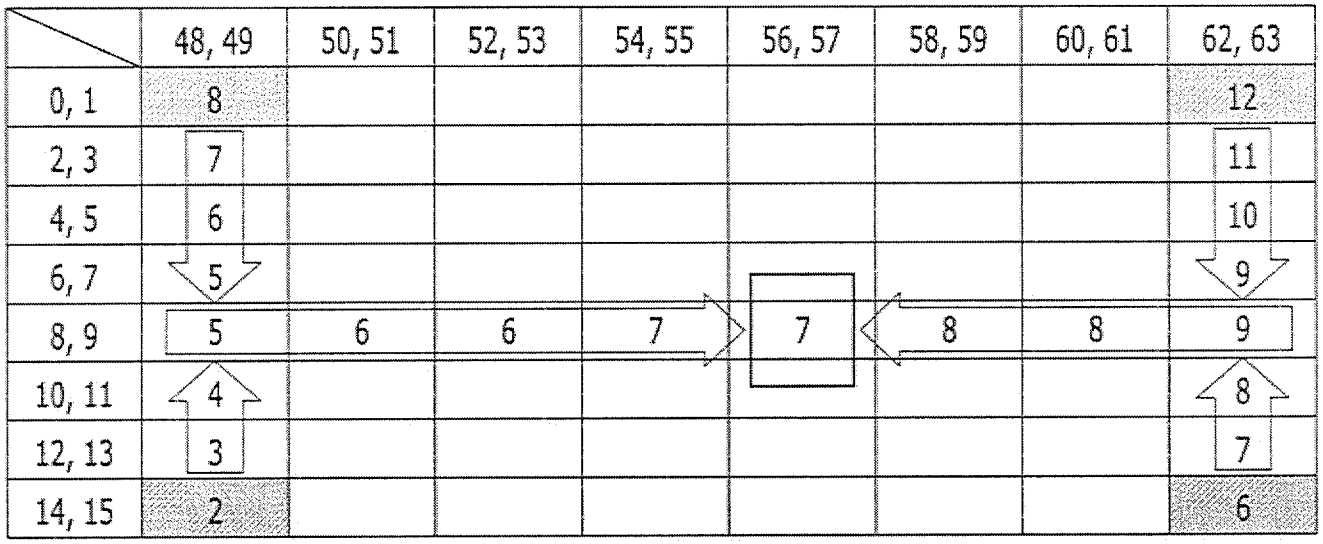
FIG. 8 illustrates a drawing of a method of calculating a correction value by an interpolation method after selecting the LUT value which may be referred to in the look-up table for compensating the image signal of the display device according to the exemplary embodiment.

FIG. 4 illustrates a block diagram of an image signal processor of the display device according to the exemplary embodiment. FIG. 5 illustrates a block diagram of an image signal compensating unit included in the image signal processor of the display device according to the exemplary embodiment. FIG. 6 illustrates a view of an example of a look-up table for compensating an image signal in the display device according to the exemplary embodiment. FIG. 7 illustrates a drawing of a method of selecting an LUT value which is referred to in a lookup table for compensating the image signal of the display device according to the exemplary embodiment. FIG. 8 illustrates a method of calculating a correction value by an interpolation method after selecting the LUT value which may be referred to in the look-up table for compensating the image signal of the display device according to the exemplary embodiment.

First, referring to FIG. 4, the image signal processor 610 of the signal controller 600 of the display device according to the exemplary embodiment includes a target pixel extracting unit 611, a correction value calculating unit 612, and an image signal compensating unit 613.

The target pixel extracting unit 611 extracts a reference pixel for compensating an image signal and a target pixel of the image signal compensation. More specifically, the target pixel extracting unit 611 sets a basic unit, i.e., a unit of compensating the image signal based on a repeated structure of the display panel 300. Further, a reference region is set to be the basic unit or to be a region which further includes at least one pixel adjacent to the basic unit.

The target pixel for compensating an image signal is a pixel to be pre-charged and designated in the basic unit. The reference pixel for compensating the image signal may be designated in the reference region and includes the pixel to be pre-charged and the pixel which affects the pre-charging. That is, in order to compensate an image for one pixel to be pre-charged, at least two reference pixels including the pixel to be pre-charged, which is the target pixel for compensating the image signal, are required.

The correction value calculating unit 612 calculates a correction value for compensating the image signal with reference to the reference pixel for compensating the image signal extracted from the target pixel extracting unit 611 and the compensation LUT 650. The reference pixel for compensating the image signal may be the first pixel PXa, which is a pixel that affects the pre-charging, and the second pixel PXb, which is a pixel to be pre-charged, in the above-described exemplary embodiment shown in FIGS. 2 and 3. In this case, the second pixel PXb serves as both the reference pixel for compensating the image signal and the target pixel for compensating the image signal.

FIG. 6 illustrates an example of the compensation LUT 650 when there are 256 gray levels of the image signal. The compensation LUT 650 stores a correction value which compensates an insufficient portion or an excessive portion of the charging rate of the pixel to be pre-charged in a portion corresponding to the gray value of the image signal of the reference target pixel for compensating the image signal.

In the compensation LUT 650 shown in FIG. 6, an index in an upper row indicates a part of gray values of the second pixel PXb and an index in a left row indicates a part of gray values of the first pixel PXa. In the compensation LUT 650 shown in FIG. 6, approximately 17 gray levels among 256 gray levels are represented.

As shown in FIG. 6, the LUT value on the diagonal where the gray value of the first pixel PXa is equal to the gray value of the second pixel PXb may be set to zero. The LUT values above the diagonal of the compensation LUT 650 are those for which the gray value of the second pixel PXb is larger than the gray value of the first pixel PXa. The LUT values below the diagonal of the compensation LUT 650 are those for which the gray value of the second pixel PXb is smaller than the gray value of the first pixel PXa.

If the gray value of the reference pixel for compensating the image signal is present in the compensation LUT 650, an LUT value at the intersection of the gray value of the first pixel PXa and the gray value of the second pixel PXb is determined as a correction value. If the gray value of the image signal of the reference pixel for compensating the image signal is not present in the compensation LUT 650, the correction value may be determined by a correction value operation using a gray value around a gray value to be sought. The correction value operation may use various operations, e.g., interpolation.

Referring to FIGS. 7 and 8, linear interpolation will be described as an example of the correction value operation.

First, referring to FIG. 7, when the gray value of the first pixel PXa is 8 and the gray value of the second pixel PXb is 56 in the compensation LUT 650, coordinates of four gray values around, i.e., on either side, these gray values, (0, 48), (0, 64), (16, 48), and (16, 64) are determined, and the LUT values VL1, VL2, VL3, and VL4 corresponding to the coordinates are calculated.

Next, as shown in FIG. 8, four LUT values VL1, VL2, VL3, VL4 are used to calculate the correction value, here, 7, using linear interpolation. The size of the compensation LUT 650 and the LUT value according to the exemplary embodiment may be changed and adjusted. Further, the compensation LUT 650 may be determined to vary depending on the color of the reference pixel for compensating the image signal.

In the compensation LUT 650 according to another exemplary embodiment, a compensated value obtained by adding or subtracting the correction value to or from the gray value of the second pixel PXb may be stored in advance in the intersection of the gray value of the first pixel PXa and the gray value of the second pixel PXb, instead of using the correction value operation described above.

Referring to FIGS. 4 and 5, the image signal compensating unit 613 compensates the image signal of a pixel which is pre-charged using the correction value calculated in the correction value calculating unit 612, that is, the target pixel of compensating the image signal to output the compensated image signal IDAT'.

More specifically, if the correction value is calculated above the diagonal of the compensation LUT 650, i.e., the gray value of the input image signal IDAT of the pixel to be pre-charged is larger than the gray value of the input image signal IDAT of the pixel which affects the pre-charging, the correction value is added to the gray value of the input image signal IDAT of the second pixel PXb which is a pixel to be pre-charged to generate the compensated image signal IDAT'. To the contrary, if the correction value is calculated below the diagonal of the compensation LUT 650, that is, the gray value of the input image signal IDAT of the pixel to be pre-charged is smaller than the gray value of the input image signal IDAT of the pixel which affects the pre-charging, the correction value is subtracted from the gray value of the input image signal IDAT of the second pixel PXb which is a pixel to be pre-charged to compensate the image signal.

As described above, the gray value of the pixel which affects the pre-charging is compared with the gray value of the pixel to be pre-charged and the correction value is subtracted from or added to the input image signal IDAT depending on the size of the gray values so that the image signal may be more precisely compensated and the deviation in the charging rate and the luminance of the pixel to be pre-charged is removed to prevent the mura from being recognized. Further, by precisely compensating the charging rate, the color expression property and a gamma characteristic may be improved.

Now, referring to FIG. 5, an exemplary embodiment of the image signal compensating unit 613 will be described in detail. Referring to FIG. 5, the image signal compensating unit 613 according to an exemplary embodiment includes a compensated value generating unit 615. The compensated value generating unit 615 compensates the image signal as described above.

Further, the image signal compensating unit 613 may further include at least one of a primary color compensation avoiding unit 614 and a specific dither map avoiding unit 616.

If the dot which includes the pixel to be pre-charged, i.e., the target pixel of compensating the image signal expresses the primary colors of red, green, and blue, the primary color compensation avoiding unit 614 outputs the original input image signal IDAT. In other words, if the dot including the pixel to be pre-charged outputs only one of red, green, and blue, such that adjacent pixels should not affect the target pixel, an original input image signal IDAT may be output. If the primary color compensation avoiding unit 614 is disposed later than the compensated value generating unit 615, the primary color compensation avoiding unit 614 does not select the compensated image signal IDAT' calculated in the compensated value generating unit 615, but selects the original input image signal IDAT to output the original input image signal.

If the primary color compensation avoiding unit 614 is disposed prior to the compensated value generating unit 615, when the dot which includes the target pixel of compensating the image signal expresses the primary colors, the primary color compensation avoiding unit 614 may prevent the input image signal IDAT to be processed in the compensated value generating unit 615 or the correction value calculating unit 612. According to another exemplary embodiment, the primary color compensation avoiding unit 614 is disposed prior to the image signal processor 610 or the target pixel extracting unit 611 of the image signal processor 610 so that the input image signal IDAT is not subjected to the image signal compensation.

If a dithering map for the compensated image signal IDAT' is a predetermined specific dithering map, the specific dither map avoiding unit 616 adjusts the value of the compensated image signal IDAT' so as to avoid the specific dithering map. The dithering map is a pixel map which converts a bit number of the input image signal IDAT before being compensated or the compensated image signal IDAT' or dithers the input image signal IDAT or the compensated image signal IDAT' if additional signal correction is required. For example, the dithering map may be used in various signal processing processes, e.g., adaptive color correction (ACC) or dynamic capacitance compensation (DCC).

If a dithering map is applied to the compensated image signal IDAT', noise may occur, resulting in bad image quality. In this case, the dithering map may be tuned. However, if tuning the dithering map cannot improve the image quality, a specific dithering map which may cause the bad image quality is determined. If the dithering map for the compensated image signal IDAT' is the specific dithering map, a value of the compensated image signal IDAT' may be adjusted so as to avoid the specific dithering map. The adjusted value of the compensated image signal IDAT' may not be a large value, for example, ±1 or ±2, but is not limited thereto.

If the compensated image signal IDAT' is input to the primary color compensation avoiding unit 614 or the specific dither map avoiding unit 616, an order of the operations of the primary color compensation avoiding unit 614 and the dither map avoiding unit 616 may be changed.

Figure 9:
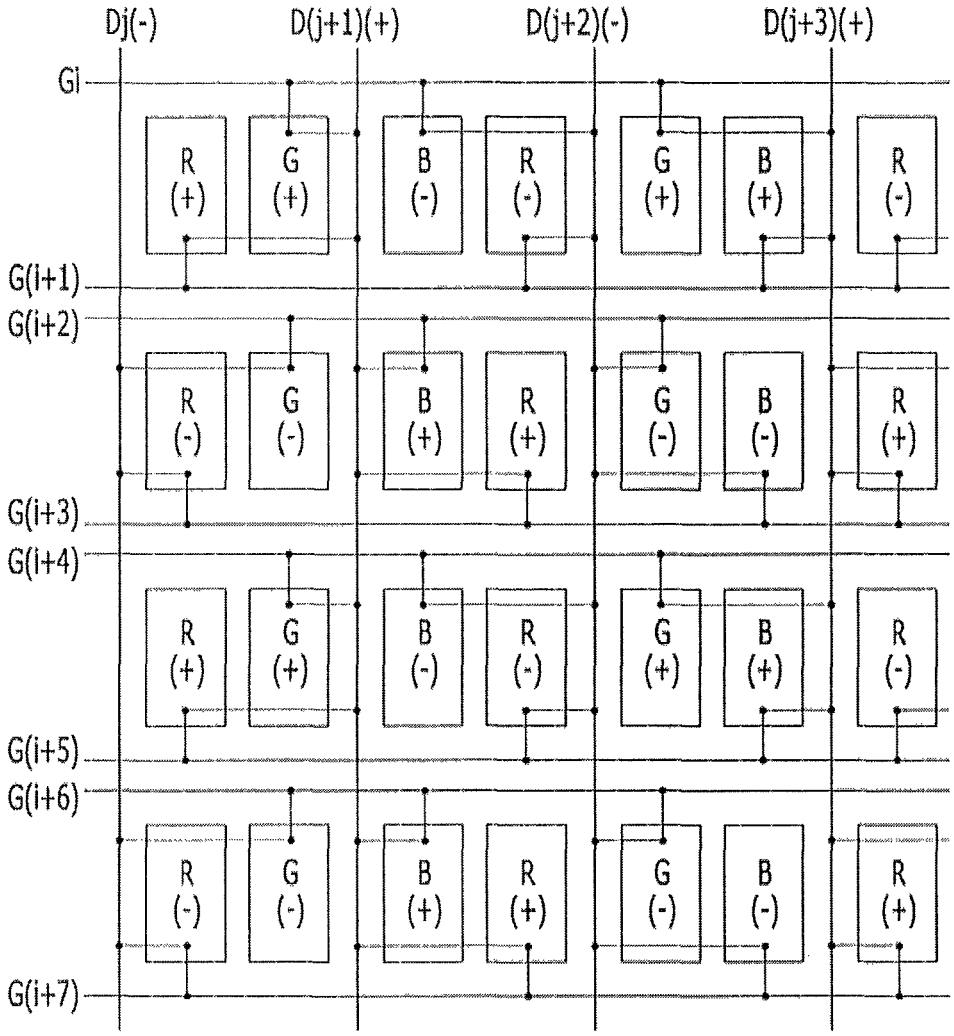
FIG. 9 illustrates a layout view of the pixel and the signal line of the display device according to the exemplary embodiment.
Figure 10:
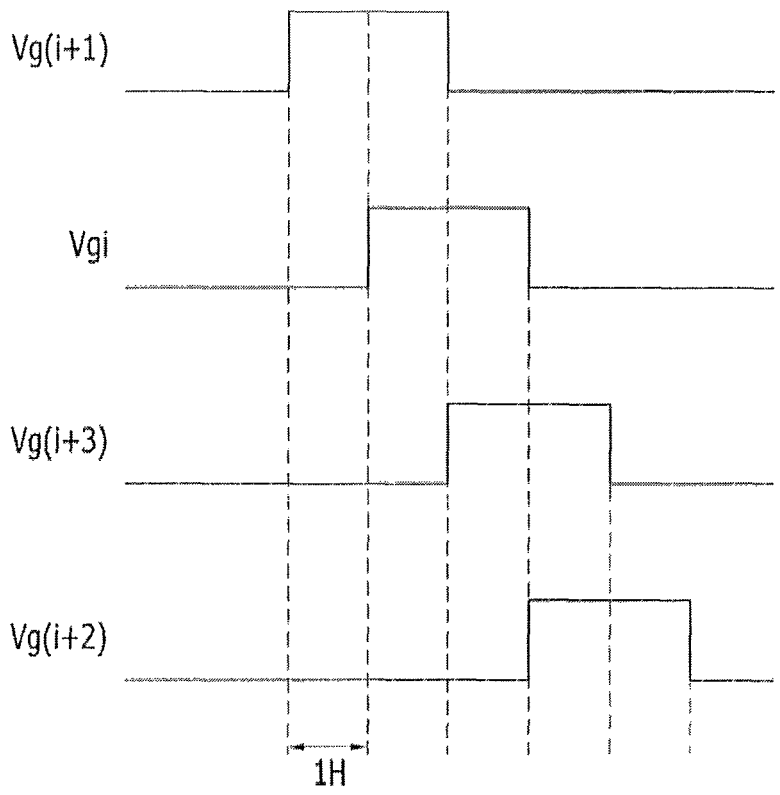
FIG. 10 illustrates a timing chart of a driving signal of the display device illustrated in FIG. 9.

Now, referring to FIGS. 9 and 10 together with the above-described drawings, an example of a specific structure of the display device according to the exemplary embodiment will be described. FIG. 9 illustrates a layout view of the pixel and the signal line of the display device according to the exemplary embodiment and FIG. 10 is a timing chart of a driving signal of the display device illustrated in FIG. 9.

Referring to FIG. 9, the display panel 300 according to the exemplary embodiment of the present invention includes a plurality of gate lines G1, G(i+1), . . . , G(i+7) extending along a row direction, a plurality of data lines Dj, D(j+1), . . . , D(j+3) extending along a column direction, and a plurality of pixels R, G and B.

Pixels which represent the same primary color may be disposed along the same pixel column. For example, a pixel column for red pixels R, a pixel column for green pixels G, and a pixel column for blue pixels B may be alternately disposed. Two pixels R, G, and B are disposed between two adjacent data lines Dj, D(j+1), . . . , D(j+3) and two gate lines Gi, G(i+1), . . . , G(i+7) may be disposed for every pixel row, but are not limited thereto.

If two gate lines Gi, G(i+1), . . . , G(i+7) are disposed for every pixel row, the pixels R, G, and B of each pixel row may be connected to any one of two gate lines Gi, G(i+1), . . . , G(i+7). The pixels R, G, and B disposed in one pixel row may be connected to any one of two adjacent data lines Dj, D(j+1), . . . , D(j+3). More specifically, the pixels R, G, and B disposed in one pixel column may be alternately connected to two adjacent data lines Dj, D(j+1), . . . , D(j+3).

Particularly, a pair of pixels R, G, and B connected to different gate lines Gi, G(i+1), . . . , G(i+7) in one pixel row is connected to the same data lines Dj, D(j+1), . . . , D(j+3). More specifically, the pair of pixels R, G, and B between two adjacent data lines Dj, D(j+1), . . . , D(j+3) may be connected to two different gate lines Gi, G(i+1), . . . , G(i+7) and the same data line Dj, D(j+1), . . . , D(j+3).

Data voltages having opposite polarities may be applied to adjacent data lines Dj, D(j+1), . . . , D(j+3). A polarity of the data voltage may be inversed for every frame.

Therefore, the pixels R, G, and B that are adjacent in the column direction are applied with data voltages having opposite polarities and two pixels R, G, and B in one pixel row are applied with the data voltages having opposite polarities so as to be substantially driven as a dot inversion type. That is, even though the data voltage which is applied to the data lines Dj, D(j+1), . . . , D(j+3) is driven as a column inversion which maintains the same polarities during one frame, the dot inversion driving may be implemented.

Referring to FIG. 10, a gate-on voltage Von of the gate signals Vgi, Vg(i+1), . . . , Vg(i+2) is sequentially applied for a period of one horizontal period 1H. In the exemplary embodiment shown in FIG. 9, the gate-on voltage Von is applied to the lower gate line Gi, G(i+1), . . . , G(i+7) between the pair of gate lines Gi, G(i+1), . . . , G(i+7) which is disposed in one pixel row, first, but is not limited thereto.

Two gate on voltage Von periods of two gate signals Vgi, Vg(i+1), . . . , Vg(i+2) to which the gate-on voltage Von is continuously in time applied partially overlap. A front part of the gate-on voltage Von corresponds to the pre-charge period Pre where the pixels R, G, and B connected to the gate lines Gi, G(i+1), . . . , G(i+7) are pre-charged. Other description for the pre-charging method is the same as the description of the exemplary embodiment with reference to FIGS. 2 and 3, and thus the detailed description thereof will be omitted.

Now, the compensating method of the image signal of the display device according to the exemplary embodiment shown in FIGS. 9 and 10 will be described with reference to FIGS. 11A, 11B, and 12 together with the above-described drawings.

Figure 11A:
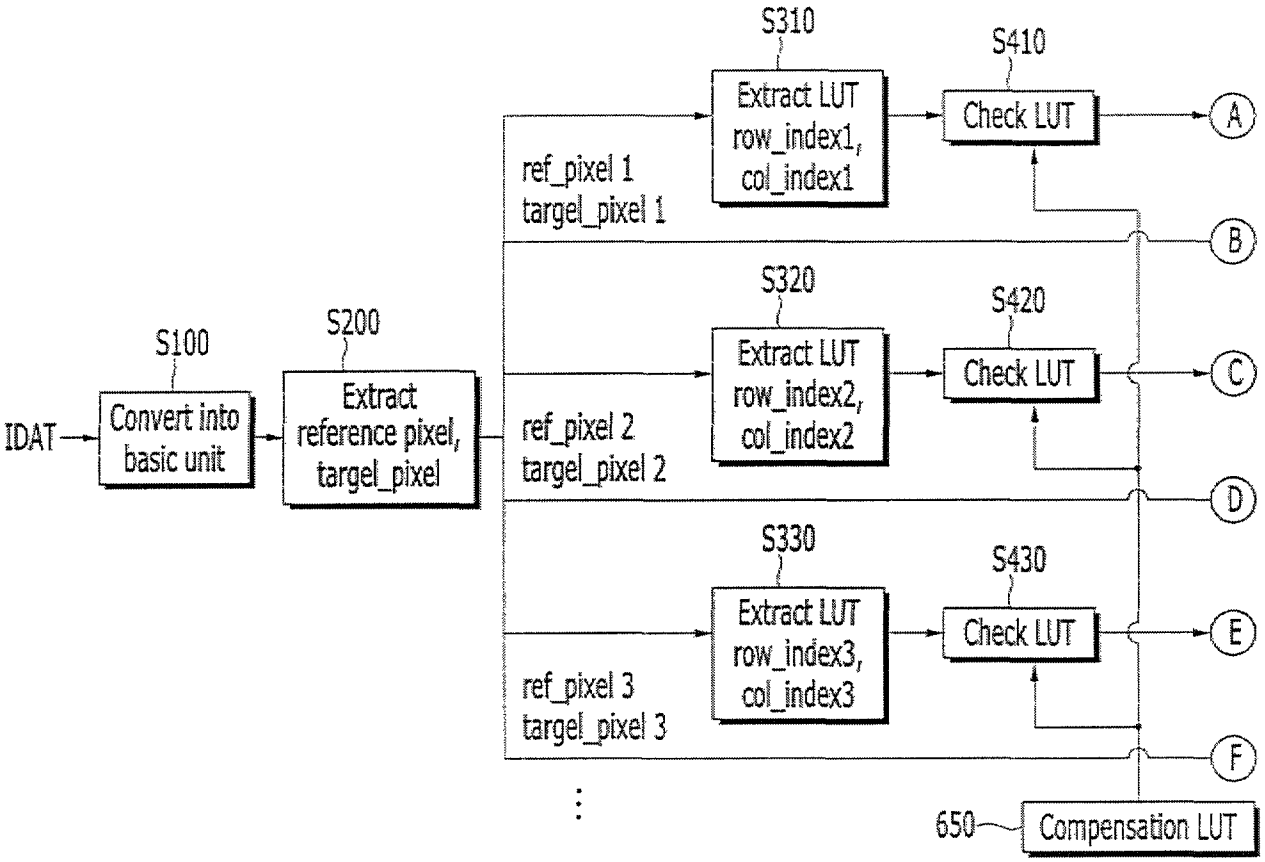
FIGS. 11A and 11 B illustrate flowcharts of methods of compensating image signals in the display device according to the exemplary embodiments.

FIG. 11A illustrates a flowchart of a method of compensating an image signal in the display device according to the exemplary embodiment. FIG. 12 illustrates a layout view of the pixel and the signal line of a method of designating a reference pixel and a compensation pixel in order to compensate the image signal in the display device according to the exemplary embodiment.

Figure 12:
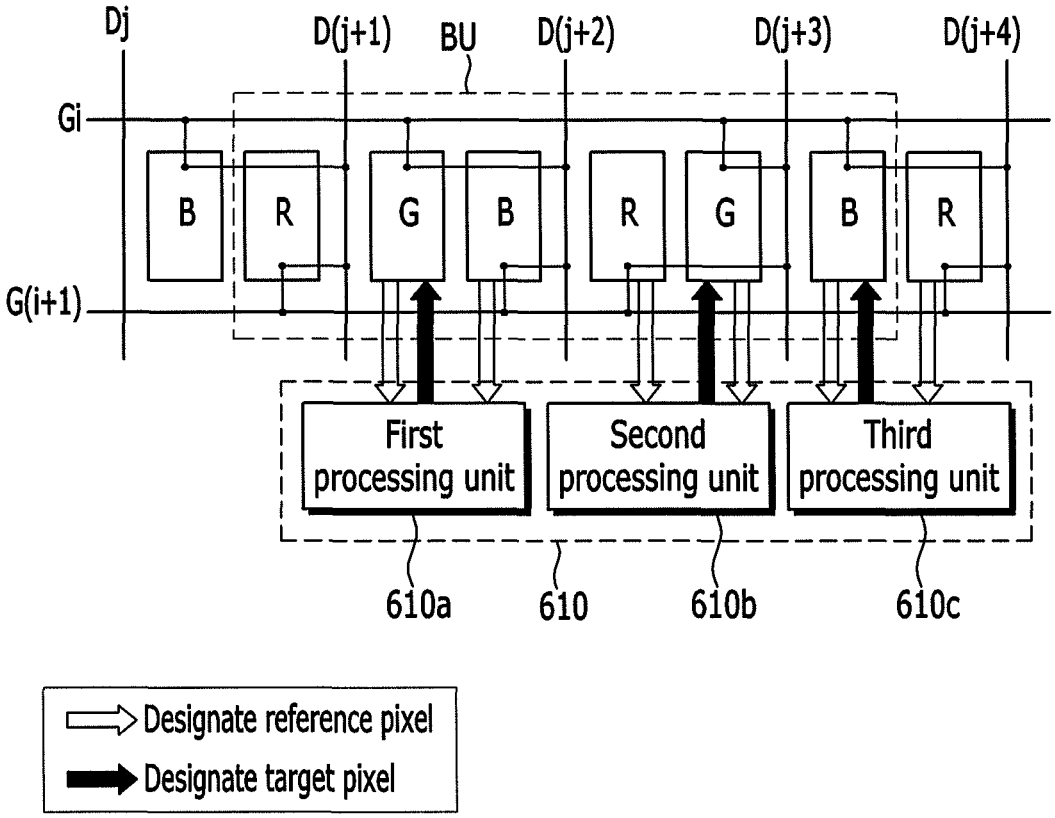
FIGS. 12 to 14 illustrate layout views of the pixel and the signal line of a method of designating a reference pixel and a compensation pixel in order to compensate the image signal in the display device according to the exemplary embodiment.

First, referring to FIGS. 11A and 12, if the input image signal IDAT is input to the signal controller 600, in operation S100, a basic unit BU, which is a unit of compensating the image signal, and a reference region, which is referred to for compensating the image signal, are set based on a repeated structure of the display panel 300 and the input image signal IDAT is divided by the basic unit BU to convert the input image signal IDAT.

In the exemplary embodiment shown in FIG. 9 or FIG. 12, the structure of the display panel 300 is repeated in the unit of six pixels R, G, and B in the row direction. Thus, the basic unit BU has six pixels R, G, and B adjacent in the row direction. FIG. 12 shows the basic unit BU which starts from the red pixel R as an example.

Next, in operation S200, the target pixel target_pixel for image signal compensation is extracted from the basic unit BU and a reference pixel for image signal compensation is extracted from the reference region. The target pixel target_pixel may be a pixel to be pre-charged and the reference pixel may be a pixel which affects the pre-charging and the pixel to be pre-charged.

In the exemplary embodiment shown in FIG. 12, the target pixel target_pixel of compensating an image signal is pixels G and B which will be charged later in the basic unit BU and the reference pixel for compensating the image signal includes the target pixel target_pixel and a pixel which is charged prior to the target pixel target_pixel. Therefore, the number of reference pixels is six.

In the case of the exemplary embodiment shown in FIG. 12, three pairs of reference pixels and three target pixels target_pixel are designated for every basic unit BU so that the image signal processor 610 may include three processing units, i.e., a first processing unit 610*a*, a second processing unit 610*b*, and a third processing unit 610*c* which compensate the image signal, but is not limited thereto. Referring to FIGS. 11 and 12, the first processing unit 610*a* may designate one pair of reference pixels ref_pixel1 and one target pixel target_pixel1, the second processing unit 610*b* may designate one pair of reference pixels ref_pixel2 and one target pixel target_pixel 2, and the third processing unit 610*c* may designate one pair of reference pixels ref_pixel3 and one target pixel target_pixel3.

Next, in operations S310, S320, and S330, the input image signals IDATs of the designated reference pixels ref_pixel1, ref_pixel2, and ref_pixel3, and the target pixels target_pixel1, target_pixel2, and target_pixel3 are used to extract row indexes row_index1, row_index2, and row_index3, and column indexes col_index1, col_index2, and col_index3 from the compensation LUT 650.

Next, in operations S410, S420, and S430, an LUT value at the intersection or a plurality of LUT values adjacent to the intersection are sought referring to the compensation LUT 650 and using the row indexes row_index1, row_index2, and row_index3 and the column indexes col_index1, col_index2, and col_index3.

Figure 11B:
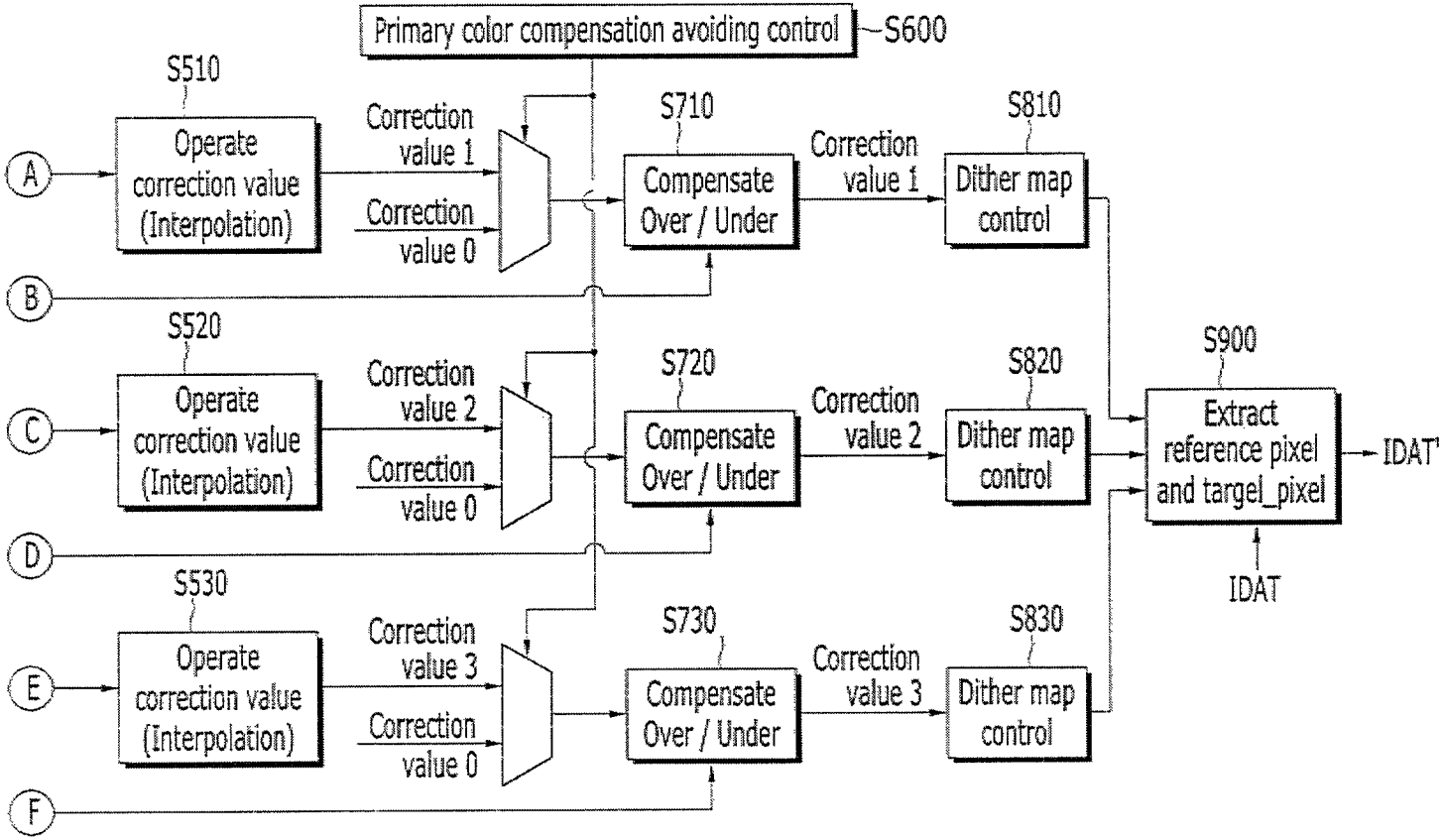

Next, referring to FIG. 11B, in operations S510, S520, and S530, the LUT value is determined as a correction value or if necessary, the correction values (correction values 1, 2 and 3) are operated by additional operation such as the above-mentioned interpolation.

Next, if the dot including the pixel to be pre-charged, i.e., the target pixel target_pixel for image signal compensation expresses the primary colors such as red, green and blue, in operation S600, the primary color compensation avoiding unit 614 outputs zero instead of the correction values (correction values 1, 2, and 3) so as not to compensate the image signal.

Next, the image signal compensating unit 613 uses the correction values (correction values 1, 2, and 3) selected by the primary color compensation avoiding unit 614 or zero to compensate the image signal of the pixel to be pre-charged, that is, the target pixel of compensating the image signal to output the compensated image signal (compensated values 1, 2, and 3). In operations S710, S720, and S730, if a gray value of the input image signal IDAT of the target pixel target_pixel is larger than the gray value of the input image signal IDAT of the pixel which affects the pre-charging, the correction value (correction values 1, 2, and 3) is added to the gray value of the input image signal IDAT of the target pixel target_pixel (over) and, if a gray value of the input image signal IDAT of the target pixel target_pixel is smaller than the gray value of the input image signal IDAT of the pixel which affects the pre-charging, the correction value (correction values 1, 2, and 3) is subtracted from the gray value of the input image signal IDAT of the target pixel target_pixel (under).

Next, in operations S810, S820, and S830, if a dithering map for the compensated image signal (compensated values 1, 2, and 3) is a predetermined specific dithering map, the value of the compensated image signal (the compensated values 1, 2, and 3) is adjusted so as to avoid the specific dithering map.

An order of a primary color compensation avoiding control operation S600, operations generating the compensated image signal (compensated values 1, 2, and 3) S710, S720, and S730, and dither map control operations S810, S820, and S830 may be changed.

Next, in operation S900, a finally generated compensated image signal IDAT' is output. If the image compensating function is not selected, the original input image signal IDAT may be output instead of the image signal IDAT' which is compensated in this step.

Now, a display device and an image signal compensating method according to an exemplary embodiment will be described with reference to FIGS. 13 and 14 together with the above-described drawings.

Figure 13:
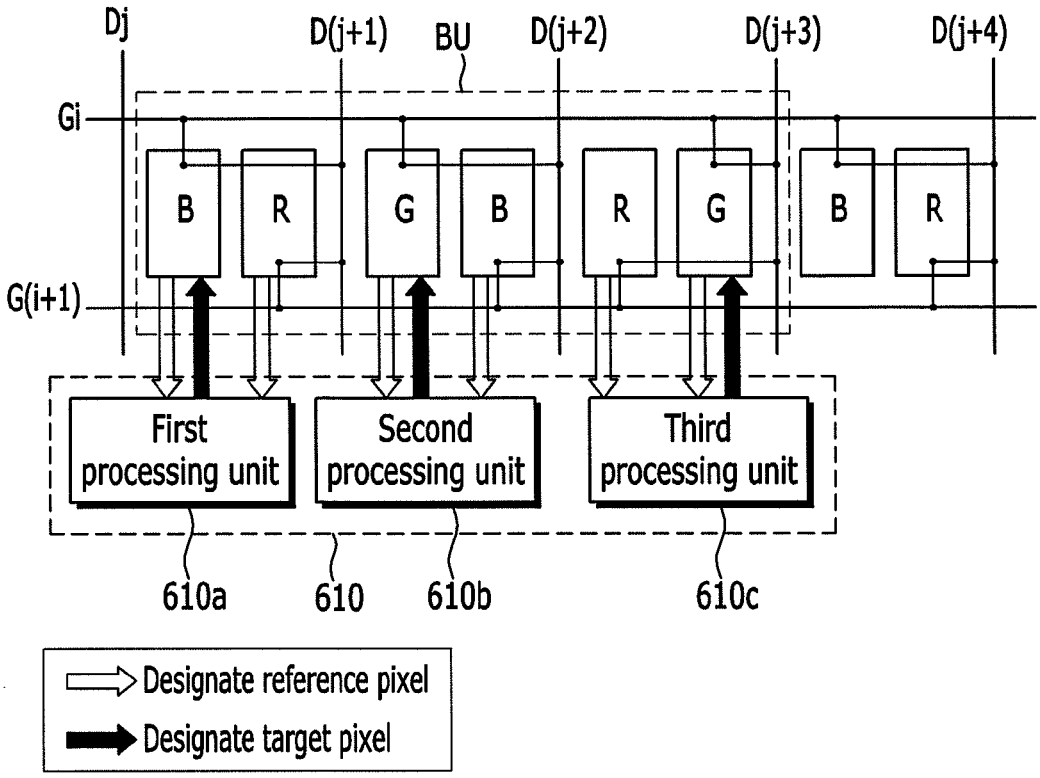
Figure 14:
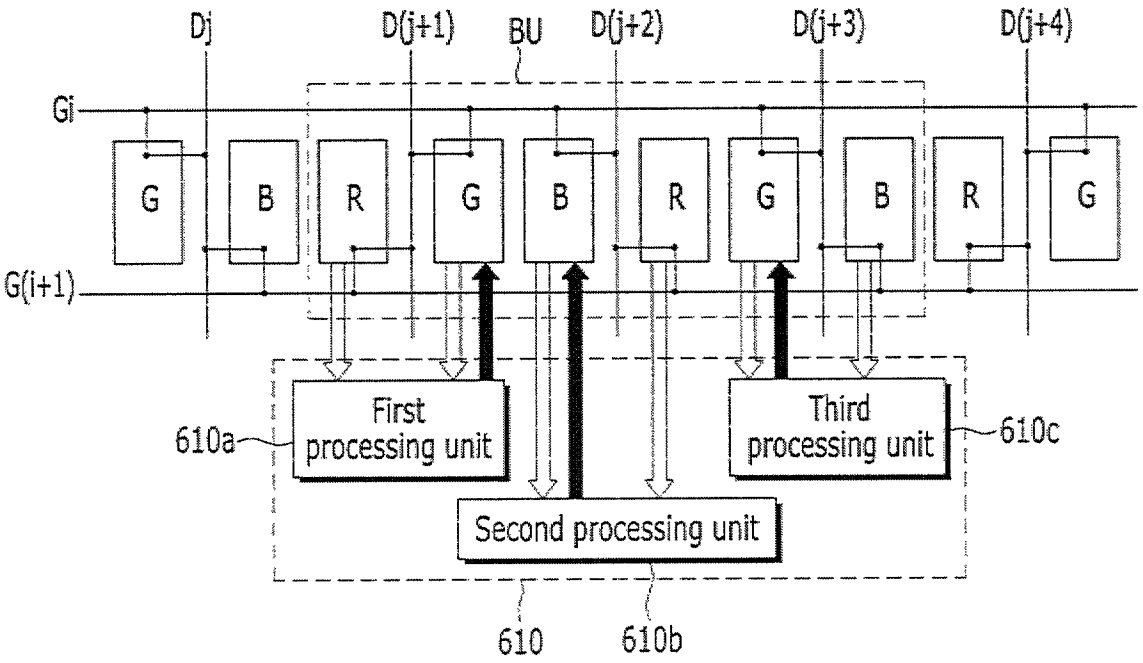

FIGS. 13 and 14 are layout views of the pixel and the signal line illustrating a method of designating a reference pixel and a compensation pixel in order to compensate the image signal in the display device according to the exemplary embodiment.

First, referring to FIG. 13, the present exemplary embodiment is mostly similar to the exemplary embodiment which has been described with reference to FIGS. 9 to 12, but the basic unit BU may be differently designated. In the present exemplary embodiment, an example in which the basic unit BU is designated having the blue pixel B as a first pixel is shown. In this case, the basic unit BU may be equal to the reference region.

In the present exemplary embodiment, the pixel pairs of the basic unit BU may be designated as reference pixels in the first processing unit 610*a*, the second processing unit 610*b*, and the third processing unit 610*c* and the pixel which is charged later among the pair of reference pixels may be designated as the target pixel target_pixel.

Finally, referring to FIG. 14, the present exemplary embodiment is mostly similar to the exemplary embodiment which has been described with reference to FIG. 9, but the pixels which are connected to the two gate lines Gi and G(i+1) and the same data lines Dj, D(j+1), . . . , D(j+4) disposed in one pixel row may be disposed at both sides of the same data lines Dj, D(j+1), . . . , D(j+4).

Further, the basic unit BU may be variously designated but in the exemplary embodiment shown in FIG. 14, an example in which the basic unit BU is designated having the red pixel R as a first pixel is shown. In this case, the basic unit BU may be equal to the reference region.

Each pixel pair of the basic unit BU in the present exemplary embodiment may be designated as a reference pixel in the first processing unit 610*a*, the second processing unit 610*b*, and the third processing unit 610*c* or the pixel which is charged later between each pair of reference pixels may be designated as the target pixel target_pixel.

By way of summation and review, one or more embodiments are directed to providing a display device and an image signal compensating method which are capable of removing a luminance deviation caused by a difference in a charging rate which may vary depending on the pixel in a display device in which the pre-charging method is used to improve a display mura.

Further, one or more embodiments are directed to providing a display device and an image signal compensating method which remove luminance deviation caused by the difference in a charging rate which may vary depending on the pixel in the display device in which a pre-charging method is used to improve a color expression property and a gamma characteristic.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a first pixel connected to a first gate line and a data line;

a second pixel connected to a second gate line, different from the first gate line, and the data line, the second pixel being pre-charged during a pre-charging period when the first pixel is charged and mainly charged during a main charging period after finishing charging of the first pixel;

a compensation look-up table (LUT) that stores LUT values for compensating a charging rate during the main charging period of the second pixel; and an image signal processor that generates a compensated image signal for the main charging period of the second pixel, wherein the image signal processor includes:

a correction value calculator to calculate a correction value from the compensation LUT based on a first input image signal of the first pixel and a second input image signal of the second pixel; and a compensated value generator to generate a compensated image signal of the second pixel by adding or subtracting the correction value to or from the second input image signal of the second pixel.

2. The display device as claimed in claim 1, wherein the compensated value generator is to:

subtracts the correction value from the second input image signal if a gray value of the first input image signal is larger than a gray value of the second input image signal, and adds the correction value to the second input image signal if a gray value of the first input image signal is smaller than a gray value of the second input image signal.

3. The display device as claimed in claim 2, further comprising:

a display panel including a plurality of pixels arranged in a matrix, the plurality of pixels including the first pixel and the second pixel, wherein the image signal processor includes a target pixel extractor to set a basic unit, which is a repeated structure of the display panel, and a reference region, which is equal to or larger than the basic unit, the target pixel extractor to extract a target pixel for compensating of an image signal from the basic unit, the target pixel including the second pixel, and to extract at least two reference pixels including the first pixel and the second pixel from the reference region.

4. The display device as claimed in claim 3, further comprising:

a primary color compensation avoider which, if a dot including the second pixel expresses a primary color, is to control the image signal processor to output the second input image signal which is not compensated.

5. The display device as claimed in claim 3, wherein:

the image signal processor further includes a specific dither map avoider which, if a dithering map for the compensated image signal corresponds to a specific dithering map, is to adjust the compensated image signal so as to avoid the specific dithering map.

6. The display device as claimed in claim 5, further comprising:

a primary color compensation avoider which, if a dot including the second pixel expresses a primary color, is to control the image signal processor to output the second input image signal which is not compensated, wherein an operating order of the primary color compensation avoider and the specific dither map avoider is changeable.

7. The display device as claimed in claim 6, wherein:

the compensation LUT stores a plurality of LUT values corresponding to a plurality of gray values of the first input image signal of the first pixel and a plurality of gray values of the second input image signal of the second pixel, and the LUT value on a diagonal of the compensation LUT is zero.

8. The display device as claimed in claim 7, wherein: the correction value calculator is to use interpolation to calculate the correction value.

9. The display device as claimed in claim 1, further comprising:

a display panel including a plurality of pixels arranged in a matrix, the plurality of pixels including the first pixel and the second pixel, wherein the image signal processor includes a target pixel extractor to set a basic unit, which is a repeated structure of the display panel, and a reference region, which is equal to or larger than the basic unit, the target pixel extractor to extract a target pixel for compensating of an image signal from the basic unit, the target pixel including the second pixel, and to extract at least two reference pixels including the first pixel and the second pixel from the reference region.

10. The display device as claimed in claim 1, further comprising:

a primary color compensation avoider which, if a dot including the second pixel expresses a primary color, is to allow the image signal processor to output the second input image signal which is not compensated.

11. The display device as claimed in claim 1, wherein:

the image signal processor further includes a specific dither map avoider which, if a dithering map for the compensated image signal correspond to a specific dithering map, is to adjust the compensated image signal so as to avoid the specific dithering map.

12. An image signal compensating method, comprising:

during a pre-charging period when a first pixel connected to a first gate line and a data line is charged, pre-charging a second pixel connected to a second gate line, different from the first gate line, and the data line;

calculating a correction value from a compensation LUT based on a first input image signal of the first pixel and a second input image signal of the second pixel;

generating a compensated image signal of the second pixel by adding or subtracting the correction value to or from the second input image signal of the second pixel; and main-charging the second pixel with a data voltage corresponding to the compensated image signal during a main-charging period after finishing charging of the first pixel.

13. The image signal compensating method as claimed in claim 12, wherein:

when generating the compensated image signal of the second pixel, if a gray value of the first input image signal is larger than a gray value of the second input image signal, the correction value is subtracted from the second input image signal, and if a gray value of the first input image signal is smaller than a gray value of the second input image signal, the correction value is added to the second input image signal.

14. The image signal compensating method as claimed in claim 13, wherein the first and second pixels are pixels in a display panel including a plurality of pixels arranged in a matrix, the method further comprising:

setting a basic unit, which is a repeated structure of the display panel, and a reference region, which is equal to or larger than the basic unit;

extracting a target pixel for compensating of an image signal from the basic unit, the target pixel including the second pixel; and extracting at least two reference pixels including the first pixel and the second pixel from the reference region.

15. The image signal compensating method as claimed in claim 14, further comprising: if a dot including the second pixel expresses a primary color, outputting the second input image signal which is not compensated.

16. The image signal compensating method as claimed in claim 15, further comprising: if a dithering map for the compensated image signal corresponds to a specific dithering map, adjusting the compensated image signal so as to avoid the specific dithering map.

17. The image signal compensating method as claimed in claim 16, wherein:

the compensation LUT stores a plurality of LUT values corresponding to a plurality of gray values of the first input image signal of the first pixel and a plurality of gray values of the second input image signal of the second pixel, and the LUT value on a diagonal of the compensation LUT is zero.

18. The image signal compensating method as claimed in claim 17, wherein calculating the correction value includes using an interpolation.

19. The image signal compensating method as claimed in claim 12, wherein the first and second pixels are pixels in a display panel including a plurality of pixels arranged in a matrix, the method further comprising:

setting a basic unit, which is a repeated structure of the display panel, and a reference region, which is equal to or larger than the basic unit;

extracting a target pixel for compensating of an image signal from the basic unit, the target pixel including the second pixel; and extracting at least two reference pixels including the first pixel and the second pixel from the reference region.

20. The image signal compensating method as claimed in claim 12, further comprising: outputting the second input image signal which is not compensated if a dot including the second pixel expresses a primary color.

* * * * *